US011925984B2

(12) United States Patent
Huber et al.

(10) Patent No.: US 11,925,984 B2
(45) Date of Patent: Mar. 12, 2024

(54) SINTERED MOLYBDENUM PART

(71) Applicant: PLANSEE SE, Reutte (AT)

(72) Inventors: Karl Huber, Reutte (AT); Michael O'Sullivan, Reutte (AT); Michael Eidenberger-Schober, Reutte (AT); Robert Storf, Reutte (AT)

(73) Assignee: Plansee SE, Reutte (AT)

( * ) Notice: Subject to any disclaimer, the term of this patent is extended or adjusted under 35 U.S.C. 154(b) by 0 days.

(21) Appl. No.: 16/649,489

(22) PCT Filed: Sep. 7, 2018

(86) PCT No.: PCT/AT2018/000071
§ 371 (c)(1),
(2) Date: Feb. 11, 2022

(87) PCT Pub. No.: WO2019/060932
PCT Pub. Date: Apr. 4, 2019

(65) Prior Publication Data
US 2020/0306832 A1 Oct. 1, 2020

(30) Foreign Application Priority Data
Sep. 29, 2017 (AT) ..... GM2172017

(51) Int. Cl.
*B22F 3/10* (2006.01)
*B22F 3/12* (2006.01)
*C22C 27/04* (2006.01)

(52) U.S. Cl.
CPC ..... *B22F 3/10* (2013.01); *C22C 27/04* (2013.01); *B22F 3/12* (2013.01); *B22F 2207/01* (2013.01);
(Continued)

(58) Field of Classification Search
CPC ..... C22C 27/04
See application file for complete search history.

(56) References Cited

U.S. PATENT DOCUMENTS 3,753,703 A * 8/1973 Benesovsky ..... C22C 1/045 75/244
4,370,299 A 1/1983 Morozumi
(Continued)

FOREIGN PATENT DOCUMENTS

CN 102505109 A 6/2012
CN 102703788 A 10/2012
(Continued)

OTHER PUBLICATIONS

Plansee; "Molybdenum"; Commercially Available Molybdenum Powder; https://www.plansee.com/en/materials/molybdenum.html; Retrieved from wayback Dec. 3, 2021; Date: Nov. 1, 2015 (Year: 2015).*

(Continued)

*Primary Examiner* — Alexandra M Moore
*Assistant Examiner* — Austin Pollock
(74) *Attorney, Agent, or Firm* — Laurence A. Greenberg; Werner H. Stemer; Ralph E. Locher

(57) ABSTRACT

A powder-metallurgical sintered molybdenum part which is present as a solid body has the following composition: a molybdenum content of ≥99.93% by weight, a boron content "B" of ≥3 ppmw and a carbon content "C" of ≥3 ppmw, with a total content "BaC" of carbon and boron being in a range of 15 ppmw≤"BaC"≤50 ppmw, an oxygen content "O" in a range of 3 ppmw≤"O"≤20 ppmw, a maximum tungsten content of ≤330 ppmw and a maximum proportion of other impurities of ≤300 ppmw. A powder-metallurgical process for producing such a sintered molybdenum part is also provided.

12 Claims, 4 Drawing Sheets

(52) U.S. Cl.
CPC ..... *B22F 2302/45* (2013.01); *B22F 2998/10* (2013.01)

(56) References Cited

U.S. PATENT DOCUMENTS

| | | | |
|---|---|---|---|
| 4,430,296 | A | 2/1984 | Koizumi et al. |
| 9,238,852 | B2 | 1/2016 | Paliwal et al. |
| 2006/0172454 | A1 | 8/2006 | Reis et al. |
| 2010/0108501 | A1 | 5/2010 | Inaguma et al. |
| 2017/0044646 | A1 | 2/2017 | Gong et al. |

FOREIGN PATENT DOCUMENTS

| | | | | |
|---|---|---|---|---|
| CN | 105618768 | A | * | 6/2016 |
| CN | 106062235 | A | | 10/2016 |
| DE | 3223618 | A1 | | 3/1983 |
| EP | 0043576 | A1 | | 1/1982 |
| EP | 1683883 | A1 | | 7/2006 |
| JP | S4940763 | B1 | * | 11/1974 |
| JP | S54116313 | A | | 9/1979 |
| JP | S55164071 | A | | 12/1980 |
| JP | S6221066 | B2 | | 5/1987 |
| JP | 2001279362 | A | | 10/2001 |
| JP | 2006002178 | A | * | 1/2006 |
| JP | 2010215933 | A | | 9/2010 |
| TW | 200639261 | A | | 11/2006 |
| TW | 201103987 | A | | 2/2011 |

OTHER PUBLICATIONS

Grohs C., et al.; Numerical Simulation of the entire production route of refractory metals from powder to a sintered metal product Plansee 19th Seminar (Year: 2017).*

Primig S., et al.; "On the Recrystallization Behavior of Technically Pure Molybdenum"; 17th Plansee Seminar 2009, vol. 1 (Year: 2009).*

Plansee; "Molybdenum"; Commercially Available Molybdenum Powder; https://www.plansee.com/en/materials/molybdenum.html; Retrieved from wayback Dec. 3, 2021; Date: Nov. 1, 2015 (Year: 2015) (Year: 2015).*

Bernhard Mayr-Schmolzer et al.: "Innovative Legierungs- und Verfahrenslösungen zur Erschließung neuer Anwendungsfelder für Refraktärmetalle", [Innovative alloy- and process solutions to open up new fields of application for refractory metals], 39th Hagener Symposium, Nov. 25-26, 2021—English abstract.

Fumio Morito: "Intergranular Fracture Surface Analysis of Molybdenum", Surface and Interface Analysis, vol. 15, 1990, pp. 427-432, Accepted Mar. 8, 1990.

Severin Jakob et al.: "Evaluation of grain boundary cohesion in technically pure and micro-doped molybdenum via three-point-bending tests", Department Materials Science, Montanuniversitaet Leoben, Austria, Euromat Konference 2021 in Graz, Sep. 15, 2021.

Jakob S. et al.: "Exploring grain boundary failure in technically pure and micro-doped molybdenum via bending experiments", Montan University Leoben—PLANSEE—2020 Virtual MRS Spring/Fall Meeting & Exhibit Nov. 27 to Dec. 2, 2020.

Jakob S. et al.: "Improving the strength of grain boundaries in molybdenum by segregation engineering", Montan University Leoben—PLANSEE—2020 Virtual MRS Spring/Fall Meeting & Exhibit Nov. 27 to Dec. 2, 2020.

Tomohiro Takida et al: "Mechanical Properties of Fine-Grained, Sintered Molybdenum Alloys with Dispersed Particles Developed by Mechanical Alloying", Materials Transactions, vol. 45, No. 1, Jan. 1, 2004 (Jan. 1, 2004) , pp. 143-148, XP055854647, ISSN: 1345-9678, DOI: 10.2320/matertrans.45.143.

Jacob S. et al.: "Assessment of grain boundary cohesion of technically pure and boron micro-doped molybdenum via meso-scale three-point bending experiments", Materials and Design, 207, (2021), 109848, available online May 24, 2021.

Severin Jakob et al: "Grain boundary segregation engineering in technically pure molybdenum examined via three-point-bending tests" Montan Universitaet Leoben, Austria, Annual Meeting—TMS 2022—Feb. 28, 2022.

Lutz H. et al.: "Versuche zur Desoxidation von Sintermolybdaen mit Kohlenstoff, BOR und SILIZIUM", Journal of the Less-Common Metal, 16 (1968) pp. 249-264, Jul. 16, 1968—English abstract on p. 250.

Babinsky K. et al.: "A novel approach for site-specific atom probe specimen preparation by focused ion beam and transmission electron backscatter diffraction", Ultramicroscopy 144 (2014) pp. 9-18, available online Apr. 21, 2014.

Leitner K. et al.: "Grain boundary segregation engineering in as-sintered molybdenum for improved ductility", Scripta Materialia 156 (2018), pp. 60-63, Jul. 4, 2018.

Jacob S. et al.: "Influence of crystal orientation and indenter rotation during nanoindentation near grain boundaries in molybdenum", Montan University—Materials Science, PLANSEE—TMS 2019 Annual Meeting & Exhibition, Mar. 11, 2019.

Jacob S. et al.: "Influence of crystal orientation and Berkovich tip rotation on the mechanical characterization of grain boundaries in molybdenum", Materials and Design, 182, (2019), 107998, available online Jul. 2, 2019.

Jacob S. et al.: "Exploring the mechanical character of molybdenum grain boundaries via nanoindentation and three-point-bending", Montan University—Materials Science, PLANSEE—ECI—Nanomechanical Testing in Materials Research, Conference in Malaga, Sep. 2019.

Morito Fumio: "Intergranular Fracture Surface Analysis of Molybdenum" , Surface and Interface Analysis, vol. 15, Jan. 1, 1990 (Jan. 1, 1990), pp. 427-432, XP055523612.

Lorich Alexander: PLANSEE—Product Specification PSE-675-PS-002 Rev.00, MoB15 sintered ingot, Apr. 11, 2019, www.plansee.com.

S. Jakob et al: "Effect of boron doping on grain boundary cohesion in technically pure molybdenum investigated via three-point-bending tests", Department Materials Science, Montanuniversitaet Leoben, Austria, Plansee Seminar 2022.

S. Jakob et al: "Effect of boron doping on grain boundary cohesion in technically pure molybdenum investigated via three-point-bending tests", published in the International Journal of Refractory Metals and Hard Materials, 113, (2023), 106173 (accepted Feb. 27, 2023).

PLANSEE SE: "Molybdenum Material Properties and Alloys", pp. 1-33, published (Nov. 2022).

Franz Jeglitsch, et al.: "Fortschritte in der Metallographie", pp. 1-8, published Oct. 18, 1974.

* cited by examiner

SINTERED MOLYBDENUM PART

BACKGROUND OF THE INVENTION

Field of the Invention

The present invention relates to a powder metallurgical sintered molybdenum part present as solid body and also a process for producing such a sintered molybdenum part.

Owing to its high melting point, its low coefficient of thermal expansion and its high thermal conductivity, molybdenum is suitable for various high-performance applications, for example as material for glass melting electrodes, for furnace components of high-temperature furnaces, for heat sinks and for X-ray anodes. A frequently employed and industrial-scale process for producing molybdenum and molybdenum-based materials is the powder-metallurgical production route in which appropriate starting powders are pressed and subsequently sintered, with in the case of a plurality of powders the pressing step typically being preceded by mixing of the powders. Compared to melt-metallurgically produced molybdenum, powder-metallurgically produced (hereinafter "powder-metallurgical") molybdenum is characterized by the microstructure being more fine-grained and more homogeneous because of the comparatively low sintering temperature (sintering temperature≈0.8*melting point). No demixing in the liquid phase occurs and the powder-metallurgical production route allows the production of a wider variety of preforms (from a geometric point of view).

One challenge is that molybdenum with its body-centred cubic crystal structure has a transition from ductile to brittle behaviour, depending on the state of working, around or above room temperature (e.g. at 100° C.) and is very brittle below this transition temperature. Furthermore, undeformed molybdenum and recrystallized molybdenum have a relatively low strength, in particular in respect of flexural and tensile stresses, as a result of which the range of uses is likewise restricted (these properties can be improved even in the case of conventional molybdenum by forming, e.g. rolling or forging, but they become worse again with increasing recrystallization). Finally, molybdenum cannot be welded, which necessitates either complicated joining methods (riveting, crimping, etc.) or else, in order to improve the welding properties, the addition of alloying elements (e.g. rhenium or zirconium) to the Mo base material or the use of welding additive materials (e.g. rhenium).

The U.S. Pat. No. 3,753,703 A describes a powder-metallurgical production process for a molybdenum-boron alloy, in which molybdenum boride as boron source and optionally further metallic additives such as tungsten (W), hafnium (Hf) or zirconium (Zr) are added to the starting molybdenum powder. Further molybdenum alloys having additives are known from the U.S. Pat. No. 4,430,296 A, which teaches the addition of vanadium (V), boron (B) and carbon (C) in combination, and also from the US patent application US 2017/0044646 A1, which teaches particular proportions of, inter alia, vanadium (V), carbon (C), niobium (Nb), titanium (Ti), boron (B), tungsten (W), tantalum (Ta), hafnium (Hf) and ruthenium (Ru) in combination. In the technical article "Experiments on the deoxidation of sintered molybdenum by means of carbon, boron and silicon" by H. Lutz et al. in J. Less-Common Metals, 16 (1968), 249-264, sintered molybdenum with additions of carbon (C), boron (B) and silicon (Si) is examined in each case.

Although such additions of additional alloying elements and also the above-described use of welding additive materials can, depending on the additive added (element/compound), increase the ductility, increase the strength and/or improve the weldability, the addition of additives is, depending on the application, associated with disadvantages. Thus, in glass melting components (e.g. in glass melting electrodes) an increased carbon content leads to undesirable bubble formation at the surface of the glass melting component, since, inter alia, the carbon from the Mo material reacts with oxygen from the glass melt to form carbon dioxide ($CO_2$) and carbon monoxide (CO). When welding additive materials are used, changes in the melting point, the coefficient of thermal expansion and/or the thermal conductivity compared to the Mo base material can occur in the region of the weld zone.

SUMMARY OF THE INVENTION

It is accordingly an object of the present invention to provide a molybdenum-based material which has both a high strength and good weldability and can be used universally in various applications.

The object is achieved by a powder-metallurgically produced (hereinafter: "powder-metallurgical") sintered molybdenum part present as solid body according to the description given below and also by a process for producing a sintered molybdenum part according to the description given below. Advantageous embodiments of the invention are indicated in the dependent claims.

The present invention provides a powder-metallurgical sintered molybdenum part which is present as solid body and has the following composition:

a. a molybdenum content of ≥99.93% by weight,
b. a boron content "B" of ≥3 ppmw and a carbon content "C" of ≥3 ppmw, with the total content "BaC" of carbon and boron being in the range 15 ppmw≤"BaC"≤50 ppmw, in particular in the range 25 ppmw≤"BaC"≤40 ppmw,
c. an oxygen content "O" in the range 3 ppmw≤"O"≤20 ppmw,
d. a maximum tungsten content of ≤330 ppmw and
e. a maximum proportion of other impurities of ≤300 ppmw.

Compared to conventional, powder-metallurgical, pure molybdenum (Mo) (hereinafter "conventional molybdenum"), the sintered molybdenum part of the invention has significantly increased ductility and also increased strength, in particular in respect of flexural and tensile stresses. This applies particularly in comparison with conventional molybdenum in the undeformed and/or (completely or partially) recrystallized state. In the case of conventional molybdenum, the forming of relatively large components is problematical because of the low grain bound strength. Particularly in forging of thick rods (e.g. having initial diameters in the range 200-240 mm) and the rolling of thick sheets (e.g. with initial thicknesses in the range 120-140 mm), crack formation which occurs to an increased extent in the core of the rods/sheets is problematical. In comparison, the sintered molybdenum part of the invention can be produced and processed further even on a large industrial scale. The forming of large components, for example the forging of thick rods and the rolling of thick sheets, is possible in the case of the sintered molybdenum part of the invention while avoiding internal defects and grain boundary cracks. Furthermore, the sintered molybdenum part of the invention (e.g. in sheet form) can be readily welded, so that it is not necessary to make recourse to complicated joining constructions or the use of welding additive materials as in the case of conventional molybdenum.

The low strength of conventional molybdenum is attributed to a low grain boundary strength which leads to intercrystalline fracture behaviour. The grain boundary strength of molybdenum is known to be reduced in the region of the grain boundaries by segregation of oxygen and possibly of further elements, e.g. nitrogen and phosphorus. While improving the properties of molybdenum-based materials by addition of considerable amounts of additives (elements/compounds), which increase the grain boundary strength and/or the ductility of molybdenum is known from, inter alia, the abovementioned documents of the prior art, the excellent properties of the sintered molybdenum part of the invention (high strength, high ductility, good weldability) are produced by means of the comparatively low boron (B), carbon (C) and oxygen (O) contents in combination with the low maximum contents of other impurities (and of tungsten (W)). The proportion of further elements (i.e. elements other than Mo), which depending on the application have a disadvantageous effect, is low and the sintered molybdenum part of the invention is universally usable in a variety of applications.

The invention is based on the recognition that even small contents of carbon and boron in combination lead to a significantly increased grain boundary strength and advantageously influence the flow behaviour of the material (which is responsible for the high ductility) when the oxygen content is low and at the same time the content of other impurities (and W) is below the limit values indicated. In particular, the oxygen content in the sintered part can be kept low by the carbon content. On the other hand, no large amounts of carbon, which would be problematical in the case of glass melting components because of the degassing which then occurs to an increased extent, are required because of the boron content. At the low proportions of oxygen, of other impurities and of W according to the invention, a low boron content in combination with a comparatively low carbon content is as a result sufficient to achieve the desired high ductility and strength values.

For the purposes of the present invention, a powder-metallurgical sintered molybdenum part is a component whose production comprises the steps of pressing a corresponding starting powder to give a press body and sintering the press body. In addition, the production process can have further steps, e.g. mixing and homogenization (e.g. in a ploughshare mixer) of the powders to be pressed, etc. The powder-metallurgical sintered molybdenum part thus has a microstructure typical of powder-metallurgical production, which can readily be recognized by a person skilled in the art. This microstructure is distinguished by its fine-grain nature (typical grain sizes are, in particular, in the range 30-60 μm). Furthermore, the pores are uniformly distributed through the sintered part over the entire cross section. In the case of "good" or "complete" sintering (the density is then ≥93% of the theoretical density of molybdenum and there is no open porosity), these pores appear at the grain boundaries and also as rounded voids in the interior of the sintered grains formed. The examination of these characteristic features is carried out on an optical micrograph or electron micrograph of a polished section). The powder-metallurgical sintered molybdenum part of the invention can also have been subjected to further treatment steps, e.g. forming (rolling, forging, etc.), so that it subsequently has a deformed structure, a subsequent heat treatment, etc. It can also be coated and/or joined to further components, for example by welding or soldering.

The indications according to the invention of the proportions and also the information in respect of the further developments explained below are based on the respective element under consideration (e.g. Mo, B, C, O or W), regardless of whether this is present in elemental or bound form in the sintered molybdenum part. The proportions of the various elements are determined by chemical analysis. In the chemical analysis, the proportions of most metallic elements (e.g. Al, Hf, Ti, K, Zr, etc.) are, in particular, determined by the analytical method CP-MS (mass spectroscopy with inductively coupled plasma), the boron content is determined by the analytical method ICP-OES (optical emission spectroscopy with inductively coupled plasma), the carbon content is determined by combustion analysis and the oxygen content is determined by carrier gas hot extraction. The unit "ppmw" refers to the proportion by weight multiplied by $10^{-6}$. The limit values indicted can in principle be adhered to stably even over thick components; in particular, the advantageous properties can be realized industrially independently of the respective component geometry, sheet thickness, etc. It has been observed that the boron content and the carbon content decrease slightly in the direction of the surface of the sintered part, while the oxygen content is relatively constant through the thickness of the sintered part. A slight decrease in the boron content and/or in the carbon content in the direction of the surface or a slight increase in the oxygen content in the direction of the surface is, in particular, not critical even when the limit values may then no longer be adhered to in a region close to the surface (having a thickness of, for example, 0.1 mm), and such sintered molybdenum parts are then still encompassed by the present invention when a sufficiently thick core or more generally at least one sufficiently thick layer of the sintered part, in which the limit values claimed are satisfied, remains so that crack formation or crack propagation (e.g. due to a forming step) is avoided or significantly slow at least in this core or in this layer. This is, in particular, the case when, based on the total thickness of the sintered Mo part, a core configured according to the invention is at least twice as thick as the total thickness of the regions close to the surface within which the limit values claimed are entirely or partially no longer satisfied. A gradation of the composition may occur or become greater only during subsequent treatment steps of the sintered molybdenum part, for example forming (rolling, forging, extrusion, etc.), in a subsequent heat treatment, in a welding operation, etc.

In an advantageous embodiment, the boron content and the carbon content are each ≥5 ppmw. In the case of customary analytical methods, certified contents of boron and carbon above 5 ppmw can typically be reported. As regards low boron and carbon contents, it may be remarked that although boron and carbon below a respective portion of 5 ppmw are unambiguously detectable and their proportions can be determined quantitatively (at least when the respective proportion is ≥2 ppmw), the proportions in this range can sometimes no longer be reported as certified value, depending on the analytical method. In one embodiment, the total content "BaC" of carbon and boron is in the range 25 ppmw≤"BaC"≤40 ppmw. In one embodiment, the boron content "B" is in the range 5 ppmw≤"B"≤45 ppmw, more preferably in the range 10 ppmw≤"B"≤40 ppmw. In one embodiment, the carbon content "C" is in the range 5≤"C"≤30 ppmw, more preferably in the range 15≤"C"≤20 ppmw. In these embodiments and particularly in the narrower ranges reported, both elements (B, C) are present in such a large amount and at the same time in such a sufficient amount in the sintered molybdenum part that their advantageous interaction is clearly perceptible but at the same time the carbon present and the boron present do not yet have a disadvantageous effect in the various applications. In particular, the effect of carbon is to keep the oxygen content low in the molybdenum sintered part and that of boron is to make a sufficiently low carbon content possible and at the same time achieve a high ductility and a high strength.

In one embodiment, the oxygen content "O" is in the range 5≤"O"≤15 ppmw. According to knowledge up to now, the oxygen accumulates in the region of the grain boundaries (segregation) and leads to a lowering of the grain boundary strength. Accordingly, an overall low oxygen content is advantageous. Setting such a low oxygen content can be achieved both by the use of starting powders having a low oxygen content (e.g. ≤600 ppmw, in particular ≤500 ppmw), sintering under reduced pressure, under protective gas (e.g. argon) or preferably in a reducing atmosphere (in particular in a hydrogen atmosphere or in an atmosphere having an $H_2$ partial pressure) and also by provision of a sufficient carbon content in the starting powders.

In one embodiment, the maximum proportion of contamination by zirconium (Zr), hafnium (Hf), titanium (Ti), vanadium (V) and aluminium (Al) is ≤50 ppmw in total. The proportion of each element of this group (Zr, Hf, Ti, V, Al) is preferably in each case ≤15 ppmw. In one embodiment, the maximum proportion of contamination by silicon (Si), rhenium (Re) and potassium (K) is ≤20 ppmw in total. Here, the proportion of each element of this group (Si, Re, K) is preferably in each case ≤10 ppmw, in particular ≤8 ppmw. Potassium is believed to have the effect of reducing the grain boundary strength, for which reason a very low proportion is desirable. Zr, Hf, Ti, Si and Al are oxide formers and could in principle be used to counter an accumulation of oxygen in the region of the grain boundaries by binding of the oxygen (oxygen getter) and thus in turn increase the grain boundary strength. However, they are sometimes suspected of reducing the ductility, especially when they are present in relatively large amounts. Re and V are believed to have the effect of making the sintered part ductile, i.e. they could in principle be used for increasing the ductility. However, the addition of additives (elements/compounds) means that they can also have an adverse effect, depending on the application and use conditions of the sintered Mo part. Such adverse effects of the abovementioned additives, sometimes only occurring as a function of the application, are avoided according to the present invention and in particular according to this embodiment by these elements being largely omitted. In one embodiment, the sintered molybdenum part has a total content of molybdenum and tungsten of ≥99.97% by weight. The proportion of tungsten within the limit values indicated (≤330 ppmw) is not critical for the applications known hitherto and is typically brought about by the isolation of Mo and powder production. In particular, the sintered molybdenum part has a molybdenum content of ≥99.97% by weight, i.e. it consists virtually exclusively of molybdenum. In all the embodiments discussed in this paragraph, the proportion of other impurities is very low. Accordingly, a widely usable sintered molybdenum part having a high purity is provided according to these embodiments, in each case taken for themselves and in particular in combination.

In one embodiment, the carbon and the boron are present in a total amount of at least 70% by weight based on the total content of carbon and boron in dissolved form (they thus do not form a separate phase). Studies on sintered molybdenum parts according to the invention have shown that a small proportion of the boron may be present as $Mo_2B$ phase, and this is not critical in a small amount. If the carbon and the boron are present in solution at least to a high proportion (e.g. ≥70% by weight, in particular ≥90% by weight), they can segregate at the grain boundaries and provide the abovementioned effect to a particularly great extent. The limit values indicated are preferably also adhered to by each of the elements B and C individually.

In one embodiment, the boron and the carbon are finely dispersed in the Mo base material and are present in an increased concentration in the region of the large angle grain boundaries. A large angle grain boundary is present when an angle difference of ≥15° is necessary in order for the crystallographic alignment of adjacent grains to coincide, which can be determined by means of EBSD (electron backscatter diffraction). The fine dispersion and accumulation in the region of the large angle grain boundaries enable boron and carbon to exert their positive influence on the grain boundary strength to a particularly great extent. An important aspect for achieving this fine dispersion and high enrichment at least along virtually all large angle grain boundaries (and possibly also along small angle grain boundaries) is that the boron and the carbon are added to the starting powders in the powder-metallurgical production as very pure element (B, C) or as very pure compound, i.e. with very few other impurities (apart from the binding partners of B and/or C, which may occur, e.g. Mo, N, C, etc.) and also as very fine powder. Boron can, for example, be added as molybdenum boride ($Mo_2B$), as boron carbide ($B_4C$), as boron nitride (BN) or else in elemental form as amorphous or crystalline boron. Carbon can, for example, be added as graphite or as molybdenum carbide (MoC, $Mo_2C$). The boron-containing powder (compound/element, particle size, particle morphology, etc.) and the carbon-containing powder (compound/element, particle size, particle morphology, etc.), the amounts thereof and the sintering conditions (temperature profile, maximum sintering temperature, hold time, sintering atmosphere) are preferably matched to one another in such a way that the boron and the carbon are very uniformly and finely distributed in the proportion desired in each case and in a very constant concentration over the thickness of the respective sintered molybdenum part after the sintering operation. Here, it has to be taken into account that boron and carbon do, if they are available in free form at the temperatures in question, react at least partially with oxygen from the starting powders and possibly additionally with oxygen from the sinter atmosphere and are given off as gas. In order nevertheless to achieve the desired boron and carbon contents in the finished sintered molybdenum part, correspondingly greater amounts of boron- and/or carbon-containing powders have to be added to the starting powders. Especially in the case of boron, the tendency of it to volatilize during the sintering operation and be admitted as environmentally damaging gas into the atmosphere can be countered by the boron-containing powder and the sintering conditions being matched to one another in such a way that the boron is available as reactant only after such a time and/or after such a temperature increase (e.g. because only then does the boron-containing compound decompose or the boron-containing powder release the boron for the reaction as a result of its morphology, coating, etc.) when the oxygen from the starting powders has at least largely reacted with other reaction partners (e.g. hydrogen, carbon, etc.) and has been given off as gas. Furthermore, gradation of the composition over the thickness of the sintered Mo part can largely be suppressed by the oxygen content of the starting powders being kept very low and also only a moderately increased amount of carbon- and boron-containing powders (compared to the C and B contents to be achieved in the sintered Mo part) being added, a reducing atmosphere ($H_2$ atmosphere or $H_2$ partial pressure) or alternatively a protective gas (e.g. argon) or reduced pressure preferably being selected in the sintering operation and by the boron-containing powder and the temperature profile during the sintering operation being matched to one another in such a way that the boron is liberated only when the oxygen from the starting powders has at least largely reacted with other reaction partners.

According to one embodiment, the following applies at least at one grain boundary section of a large angle grain boundary and the adjoining grain: the total proportion of carbon and boron in the region of the grain boundary section is at least one and a half times that in the region of the grain interior of the adjoining grain; in particular, the total proportion of carbon and boron in the region of the grain boundary section is at least twice, more preferably at least three times, that in the region of the grain interior of the adjoining grain. The relationships indicated are preferably also satisfied by each of the elements B and C individually. The proportions of the individual elements (B, C) and the sum of the elements (B and C) are each determined in atom percent (at %) by means of three-dimensional atom probe tomography. Here, a three-dimensional, cylindrical region having a cylinder axis running perpendicular to the grain boundary section and a thickness running along the cylinder axis of 5 nm (nanometres), which relative to the cylinder axis direction is laid centrally around the grain boundary section, is selected for the region of the grain boundary section (according to the definitive measurement method explained in detail below, this is the region of 5 nm thickness within which the sum of the measured concentrations of B and C is a maximum). The cylinder axis runs, in particular, perpendicular to the plane which is spanned by the grain boundary section in the region to be examined. In the case of a (slightly) curved grain boundary section, an average plane which maintains a minimum distance to the grain boundary section over the area under consideration is employed (for the alignment and positioning of the cylindrical region to be examined). For the region of the grain interior, a three-dimensional, cylindrical region having the same dimensions and the same orientation (i.e. same alignment and position of the cylinder axis of the cylindrical region to be examined) and having its centre 10 nm away from the grain boundary section in the cylinder axis direction (or optionally from the associated, average plane) is employed. Care has to be taken to ensure that the region of the grain interior is at the same time also sufficiently far, preferably at least 10 nm, away from further large angle grain boundaries. The three-dimensional, cylindrical regions (of the grain interior and also of the grain boundary section) each have, in particular, a (circular) diameter of 10 nm, with the associated circular area of the cylindrical regions in each case being aligned perpendicular to the associated cylinder axis (results from the cylindrical shape). Within these regions, the proportion of boron and carbon is in each case determined in atom percent. The proportions determined in this way, either of boron and carbon together or alternatively of each of the individual elements, are subsequently expressed as a ratio in each case of the region of the grain boundary section to the region of the grain interior, as explained in more detail below.

Atom probe tomography is a high-resolution characterization method for solids. Needle-like points ("sample point") having a diameter of about 100 nm are cooled to temperatures of about 60K and ablated by means of field vaporization. The position of the atom and the mass-to-charge ratio for each atom (ion) detected is determined by means of a position-sensitive detector and a flight time mass spectrometer. A more detailed description of atom probe tomography may be found in M. K. Miller, A. Cerezo, M. G. Hetherington, G. D. W. Smith, Atom probe field ion microscopy, Clarendon Press, Oxford, 1996. The sample preparation of points having a diameter of 100 nm and specific positioning of the grain boundary in this point region can be carried out only by means of FIB-based (FIB=focused ion beam) preparation. A detailed description of the sample preparation and the positioning of the grain boundary in the point region, as was also carried out for the studies carried out here, may be found in "A novel approach for site-specific atom probe specimen preparation by focused ion beam and transmission electron backscatter diffraction"; K. Babinsky, R. De Kloe, H. Clemens, S. Primig; Ultramicroscopy; 144 (2014) 9-18.

In atom probe tomography, a three-dimensional reconstruction of the sample point of the sintered molybdenum part according to the invention that is used is firstly carried out (cf. FIG. 5 and the description thereof). Here, at least the elements B and C are blended in. Proceeding from the recognition that these elements accumulate in the region of the large angle grain boundaries, the position of the large angle grain boundary in the three-dimensional reconstruction can be made visible by the enrichment of the elements B and C occurring there. A measurement cylinder which is decisive for the evaluation and has (corresponding to what has been said above) a diameter of 10 nm is positioned by means of measurement software in the three-dimensional reconstruction in such a way that a (very flat) grain boundary section (which is sufficiently far from further large angle grain boundaries) of the large angle grain boundary lies within the measurement cylinder, so that the cylinder axis of the measurement cylinder, as described above for the cylindrical regions to be examined, is aligned perpendicular to the plane spanned by the grain boundary section. The grain boundary section is preferably located essentially in the centre of the measurement cylinder, based on the cylindrical axis of the measurement cylinder. However, in this case the measurement cylinder has to be positioned and its length (along the cylinder axis) be selected (e.g. 30 nm) so that not only the cylindrical region of the grain boundary section but also the cylindrical region of the grain interior, which each have a thickness of 5 nm and whose centres are at a distance of 10 nm from one another along the cylinder axis, are each located completely within the measurement cylinder.

A one-dimensional concentration profile is subsequently determined (cf. FIG. 6 and the associated description). For this purpose, the measurement cylinder is divided along its cylinder axis into cylindrical discs each having a disc thickness of 1 nm (diameter in each case 10 nm corresponding to the diameter of the measurement cylinder). For each of these discs, the concentration (in atom percent) of at least the elements B and C (and optionally further elements such as O, N, Mo, etc.) is determined. In a graph, the concentration of at least the elements B and C determined for each disc is plotted (individually and also in total) over the length of the cylinder axis (cf. FIG. 6), with, corresponding to the subdivision, one measurement point per nanometre being plotted. As the cylindrical region of the grain boundary section to be examined, the five adjoining discs of the measurement cylinder in which the sum of the measured concentrations of B and C (B and C for each measurement point calculated in total) is a maximum are selected. As the cylindrical region of the grain interior to be examined, the five adjoining discs whose central disc is 10 nm away from the central disc of the cylindrical region of the grain boundary section are selected. For the region of the grain boundary section and correspondingly for the region of the grain interior, the proportions of B, of C and the sum of B and C are determined by adding up the proportions (in atom percent) of these elements (B, C, and B and C in total) for the five discs concerned of the region to be examined in each case and the sum is subsequently divided by five. The values obtained in this way for the region of the grain boundary section can subsequently be expressed as a ratio to the region of the grain interior.

As indicated above, the sintered molybdenum part according to the invention can also be subjected to further treatment steps, in particular forming (rolling, forging, extrusion, etc.). In one embodiment, the sintered molybdenum part has been formed at least in sections and has a preferential orientation of the large angle grain boundaries and/or large angle grain boundary sections perpendicular to the main direction of deformation, which can be determined by means of EBSD analysis of a metallographic polished section of a cross-sectional plane along the direction of deformation, in which the large angle grain boundaries (e.g. formed around a grain) and the large angle grain boundary sections (e.g. formed with an open beginning and end) are made visible. Experiments have shown that the sintered molybdenum part of the invention can be formed particularly readily and with a low reject rate. Even when forging thick rods (e.g. with initial diameters in the range 200-240 mm) and when rolling thick sheets (e.g. with initial thicknesses in the range 120-140 mm), crack formation, which in the case of conventional molybdenum occurs to an increased extent in the core of the rods/sheets, is avoided. As a result of the forming, the sintered molybdenum part has a formed structure, i.e. there are typically no more clear large angle grain boundaries running around individual grains, as occur immediately after the sintering step, but instead only large angle grain boundary sections which each have an open beginning and an open end. Sometimes (depending on the degree of deformation), sections of the large angle grain boundaries of the original grains as were present immediately after the sintering step are also discernible. Furthermore, dislocations and new large angle grain boundary sections arise as a result of forming. The original grains as were present immediately after the sintering step are, if they are still discernible, greatly squashed and distorted as a result of the forming. The preferential direction of the discernible large angle grain boundary sections runs perpendicular to the main forming direction. In particular, a relatively large proportion in terms of length (e.g. at least 60%, in particular at least 70%) of the large angle grain boundary sections is inclined more strongly to the direction perpendicular to the main forming direction (or partly also exactly parallel thereto) than to the main forming direction, which can be determined by means of EBSD analysis of a metallographic polished section of a cross-sectional plane along the main forming direction, in which the large angle grain boundary sections are made visible.

Furthermore, a heat treatment (e.g. low-stress heat treatment at temperatures in the range 650-850° C. for a time in the range 2-6 h; recrystallization heat treatment at temperatures in the range 1000-1300° C. for a time in the range 1-3 h) can also take place after the forming step. With increasing temperature and time of a heat treatment, grain growth of grains with large angle grain boundaries running around the individual grains takes place stepwise (recrystallization). In one embodiment, the sintered molybdenum part of the invention has a partially or fully recrystallized structure at least in sections (optionally also completely). Compared to conventional molybdenum having a partially or fully recrystallized structure, significantly higher ductility and strength values are achieved here.

In one embodiment, the sintered molybdenum part (in particular configured as a sheet) is joined via a weld connection to a further sintered molybdenum part (in particular configured as a sheet), with both sintered molybdenum parts being configured according to the present invention and optionally according to one or more of the further embodiments and with a weld zone of the weld connection having a molybdenum content of ≥99.93% by weight. The sintered molybdenum parts of the invention can be welded significantly better compared to conventional molybdenum. As is made clear by the specified molybdenum content of the weld zone, no addition of a welding additive material is necessary. As a result, the materials properties of pure molybdenum can also be maintained in the region of the weld zone. The weld connection has high ductility and strength values; in particular, elongations of >8% in the tensile test (in accordance with DIN EN ISO 6892-1 method B) and bending angles of up to 70° in bending tests in accordance with DIN EN ISO 7438) were measured, depending on the welding method and the welding conditions. Considerable improvements were achieved, in particular, in the case of laser beam welding and WIG welding (tungsten inert gas welding).

The present invention further provides a process for producing a sintered molybdenum part which has a molybdenum content of ≥99.93% by weight, a boron content "B" of ≥3 ppmw and a carbon content "C" of ≥3 ppmw, with the total content "BaC" of carbon and boron being in the range 15 ppmw≤"BaC"≤50 ppmw, an oxygen content "O" in the range 3 ppmw≤"O"≤20 ppmw, a maximum tungsten content of ≤330 ppmw and a maximum proportion of other impurities of ≤300 ppmw, characterized by the following steps:

a. pressing of a powder mixture composed of molybdenum powder and boron- and carbon-containing powders to give a green body;
b. sintering of the green body in an atmosphere which protects against oxidation for a residence time of at least 45 minutes at temperatures in the range 1600° C.-2200° C.

In the process of the invention, the advantages explained above in respect of the sintered molybdenum part of the invention are achieved in a corresponding way. Furthermore, corresponding embodiments as have been explained above are also possible in the process of the invention. The boron- and carbon-containing powders can likewise be molybdenum powder containing a corresponding proportion of boron and/or carbon. It is important that the starting powder used for pressing the green body contains sufficient amounts of boron and carbon and these additives are dispersed very uniformly and finely in the starting powder.

In particular, the sintering step comprises a heat treatment for a residence time of 45 minutes up to 12 hours (h), preferably of 1-5 h, at temperatures in the range 1800° C.-2100° C. In particular, the sintering step is performed under reduced pressure, under protective gas (e.g. argon) or preferably in a reducing atmosphere (in particular in a hydrogen atmosphere or in an atmosphere having an $H_2$ partial pressure.

Further advantages and useful aspects of the invention can be derived from the following description of working examples with reference to the accompanying figures.

DETAILED DESCRIPTION OF THE INVENTION

Figure 1:
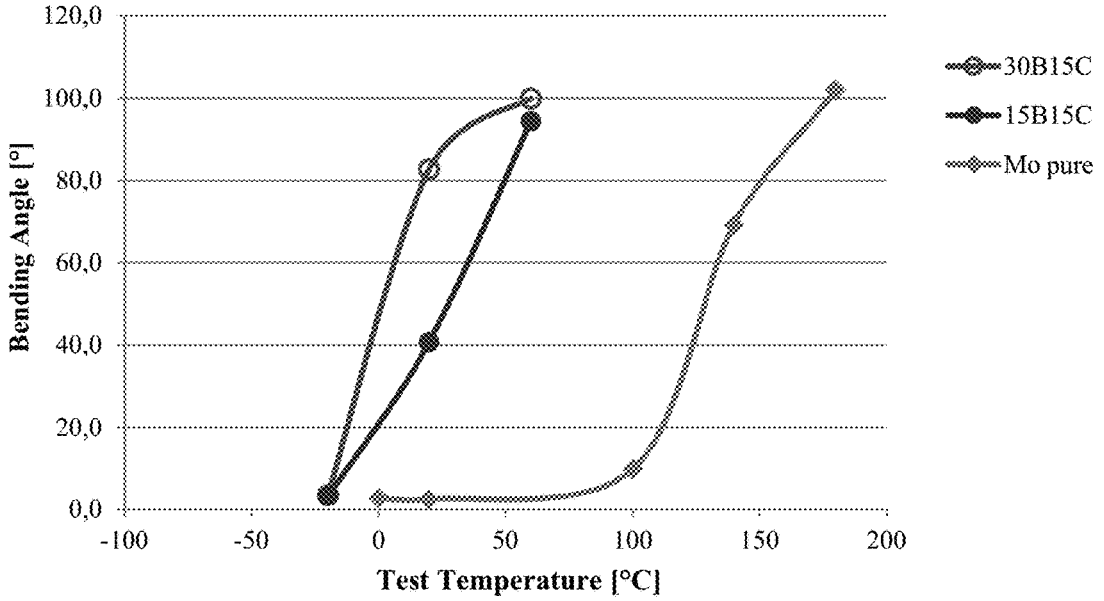
FIG. 1: graph of a 3-point bending test on specimens of various sintered molybdenum parts.
Figure 2:
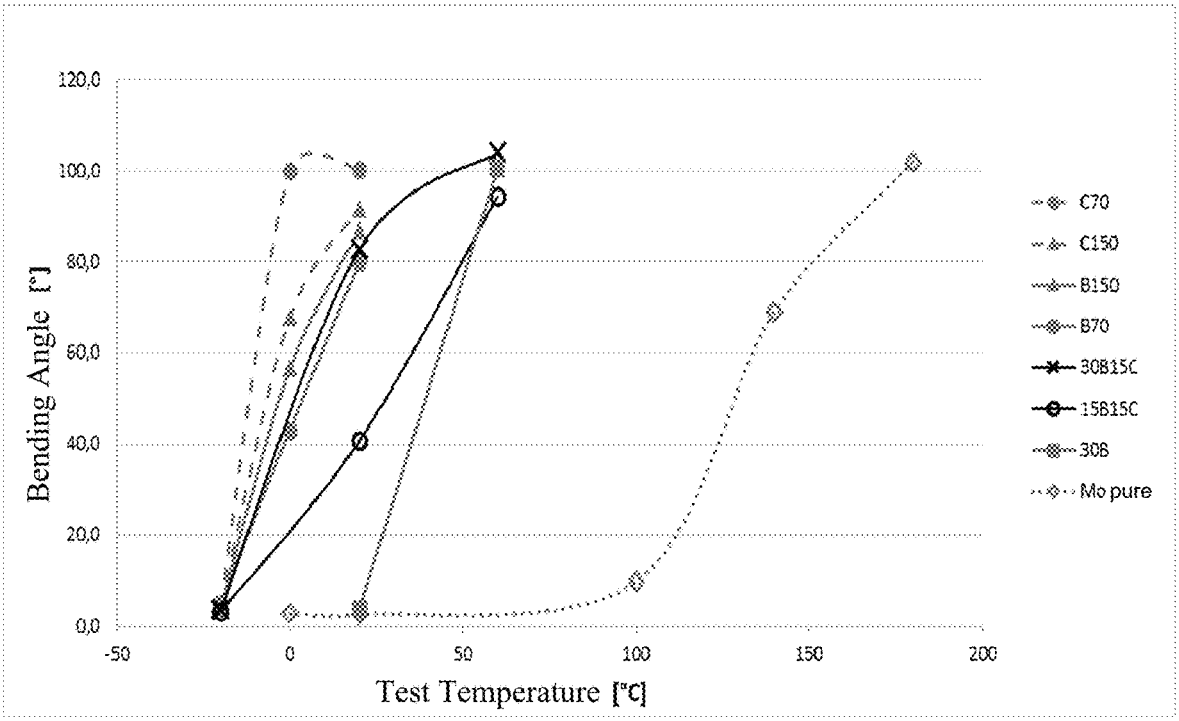
FIG. 2: corresponding graph as in FIG. 1 within inclusion of further specimens of sintered molybdenum parts.

In FIG. 1 the 3-point bending test for two sintered molybdenum parts "30B15C" and "15B15C" according to the invention and for a conventional sintered molybdenum part "Mo pure" is prepared. In FIG. 2, further sintered molybdenum parts "30B", "B70", "B150", "C70", "C150" are additionally included. The sintered molybdenum parts had the following compositions (insofar as of importance for the present invention):

| | 30B15C | 15B15C | 30B | B70 | B150 | C70 | C150 | Mo pure |
|---|---|---|---|---|---|---|---|---|
| B content [ppmw] | 30 | 15 | 30 | 70 | 150 | <5 | <5 | <5 |
| C content [ppmw] | 15 | 15 | 9 | 8 | 9 | 70 | 150 | 6 |
| O content [ppmw] | 9 | 9 | 8 | 5 | 6 | 7 | <5 | 14 |
| W content [ppmw] | ≤330 | ≤330 | ≤330 | ≤330 | ≤330 | ≤330 | ≤330 | ≤330 |
| Other impurities [ppmw] | ≤300 | ≤300 | ≤300 | ≤300 | ≤300 | ≤300 | ≤300 | ≤300 |

The bending angles shown in FIGS. 1 and 2 for the various sintered molybdenum parts were determined by means of a 3-point bending test. For this purpose, cuboidal test specimens having dimensions of 6*6*30 mm from the various sintered molybdenum parts were used in each case. The 3-point bending test was carried out in accordance with DIN EN ISO 7438 using a correspondingly configured test apparatus. The respective maximum bending angle attained, which was attained for the various test specimens at the test temperatures indicated in each case, before fracture of the test specimen occurred is plotted in FIGS. 1 and 2. This bending angle is firstly characteristic for the ductility, i.e. the higher the achievable bending angle, the higher the ductility of the respective sintered molybdenum part. Furthermore, the transition from ductile to brittle behaviour can be shown by means of the temperature dependence of the maximum achievable bending angle.

As the comparison of the sintered molybdenum parts "30B15C" and "15B15C" according to the invention with the conventional sintered molybdenum part "Mo pure" in FIG. 1 shows, the test specimens configured according to the invention attain significantly greater bending angles at the same test temperatures. At a test temperature of 60° C., in particular, the test specimen "30B15C" attains a bending angle of 99°, the test specimen "15B15C" attains a bending angle of 94° and the test specimen "Mo pure" attains a bending angle of only about 2.5°. At a test temperature of 20° C., the test specimen "30B15C" attains a bending angle of 82°, the test specimen "5B15C" attains a bending angle of 40° and the test specimen "Mo pure" attains a bending angle of only about 2.5°. As the temperature dependence of the bending angle for the individual test specimen shows, the transition from ductile to brittle behaviour can be shifted to significantly lower temperatures in the case of sintered molybdenum parts according to the invention, in particular from 110° C. in the case of "Mo pure" to −10° C. in the case of "30B15C" and to 0° C. in the case of "15B15C". The transition from brittle to ductile behaviour is assigned to the temperature at which a bending angle of 20° is attained for the first time. Furthermore, comparison of the test specimens "30B15C" and "15B15C" shows that a somewhat higher addition of boron leads, especially in the temperature range from about −20° C. to 50° C., to a further increase in the ductility, while the ductility in the other temperature ranges is comparable. For many applications, a B content of 15 ppmw and a C content of 15 ppmw will be sufficient, particularly when a very low proportion of additional elements is sought.

As the comparison with the further test specimens "B70", "B150", "C70", "C150" in FIG. 2 shows, a significantly higher B or C content also leads to only a limited increase in the ductility (when the low limit values for oxygen, W content and other impurities as defined above are adhered to), with this increase being restricted essentially to the temperature range from about −20° C. to 50° C. Furthermore, the transition from ductile to brittle behaviour is shifted only slightly to lower temperatures, when the test specimen "30615C" is taken as comparative measure representative of the present invention. With a view to the objective of the invention of providing very pure molybdenum, this graph shows that a significantly improved ductility is achieved by means of the composition ranges according to the invention without additives (elements/compounds) having to be added to any appreciable extent. The test specimen "30B", for which the transition from ductile to brittle behaviour lies at higher temperature than in the case of the test specimens "301315C" and "15615C" makes it clear that the effect of boron alone is limited and a minimum content of both carbon and boron (of, for example, in each case at least 10 ppmw, in particular in each case at least 12 ppmw) in combination has a particularly advantageous effect.

Figure 3:
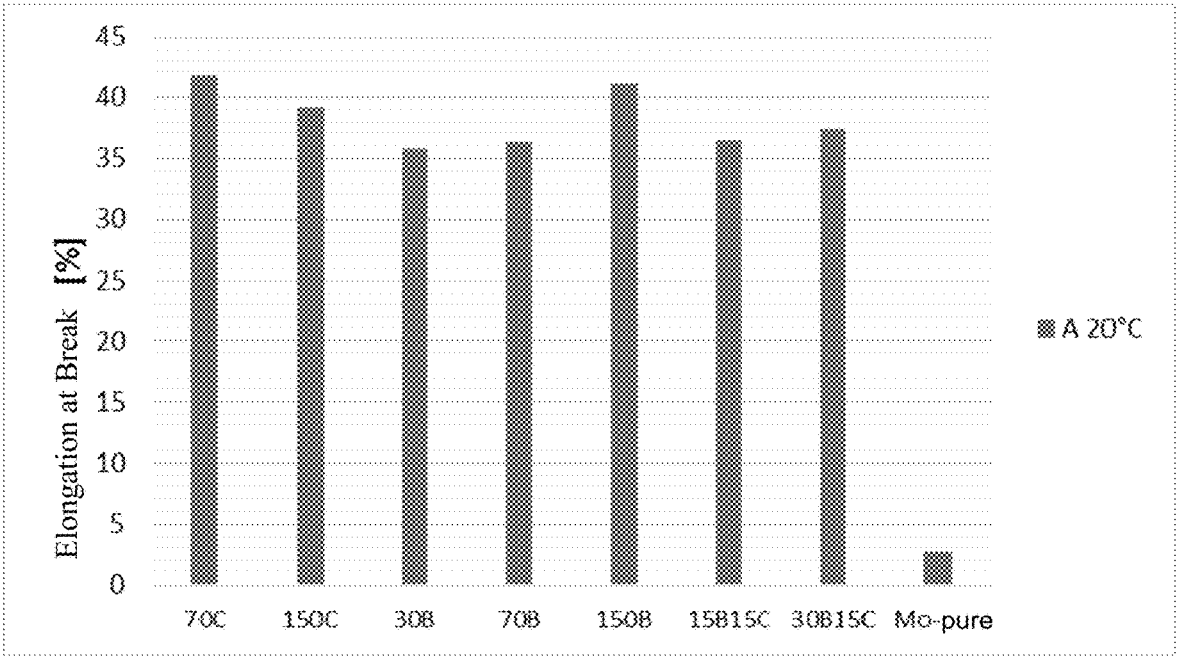
FIG. 3: graph of the elongation at break of various sintered molybdenum parts in a tensile test.
Figure 4:
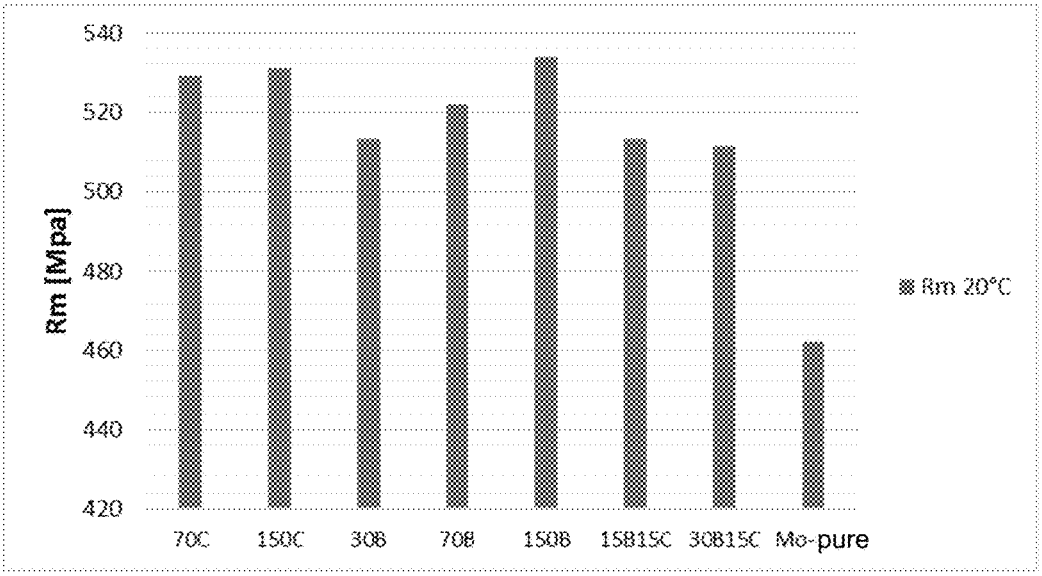
FIG. 4: graph of the breaking strength of various sintered molybdenum parts in a tensile test.

FIGS. 3 and 4 show the results of tensile tests which were carried out in accordance with DIN EN ISO 6892-1 method B on correspondingly dimensioned test bars of the sintered molybdenum parts "Mo pure", "30615C", "15615C", "150B", "70B", "30B", "150C", "70C". The elongation at break (in % of the change in length ΔL relative to the initial length L) of the various test bars is shown in FIG. 3, while the breaking strength Rm (in MPa; megapascal) of the various test bars is shown in FIG. 4. Here too, it can again be seen that the sintered molybdenum parts of the invention "30615C", "15615C" and "30B" lead to a significant increase in both materials parameters compared to "Mo pure". Furthermore, it can be seen from the test bars "70C", "150C", "70B", "150B" that greater additions of boron and/or carbon (while adhering to the low limit values for oxygen, W content and other impurities as are defined above) lead to a further increase only to a small extent. Thus, the tensile tests also confirm that excellent materials properties can be achieved within the composition ranges defined according to the invention, without additives (elements/compounds) being required to an appreciable extent.

Figure 5:
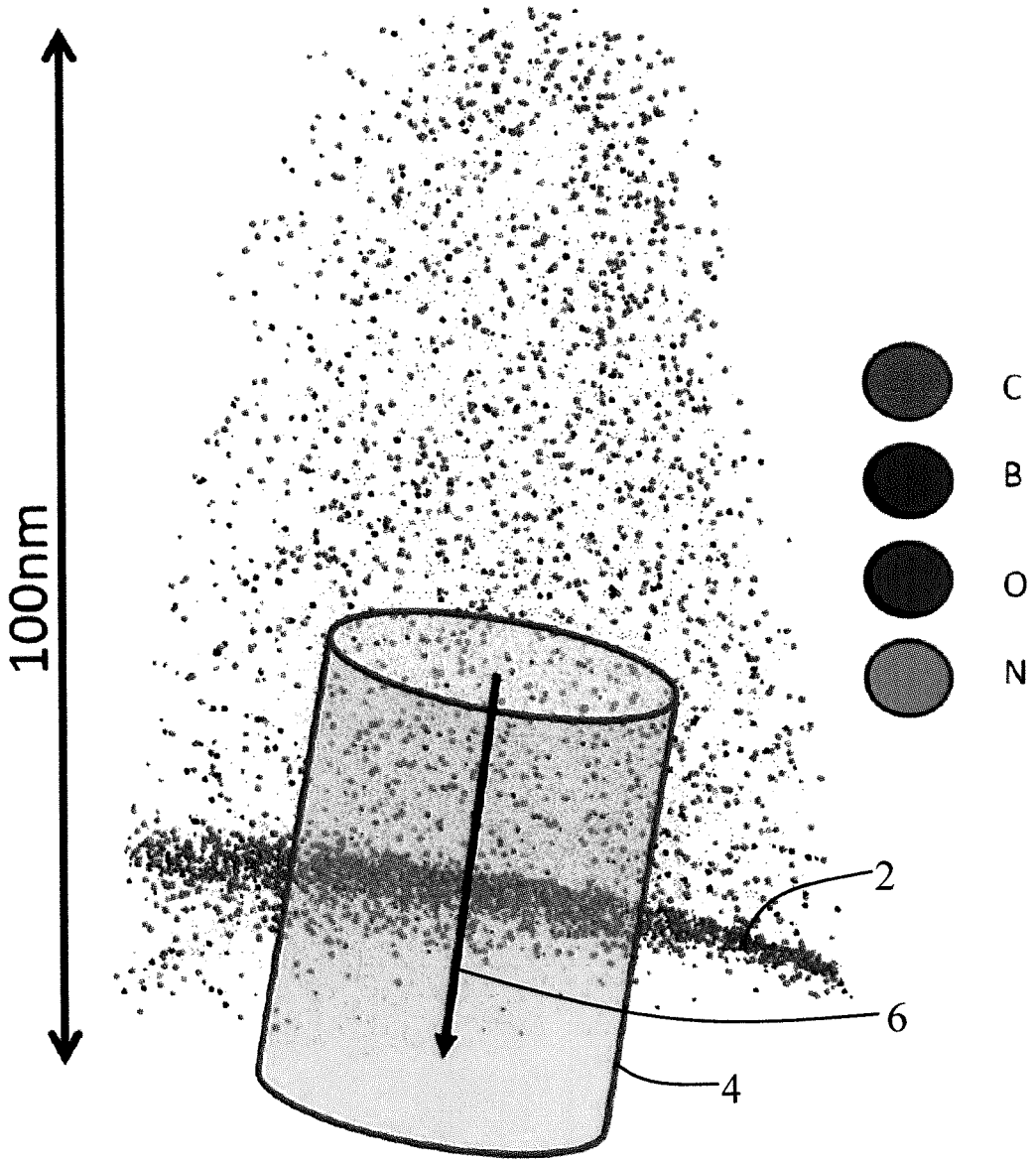
FIG. 5: three-dimensional reconstruction of a sample point of a sintered molybdenum part "15B15C" according to the invention determined by atom probe tomography, showing the elements carbon (C), boron (B), oxygen (O) and nitrogen (N)

FIG. 5 depicts a three-dimensional reconstruction of a sample point of a sintered molybdenum part "15B15C" according to the invention determined by atom probe tomography. In this depiction, the position of the C atoms in the sample point is shown in red, that of the B atoms is shown in violet, that of the O atoms is shown in blue and that of the N atoms is shown in green. Furthermore, the Mo atoms are indicated as small dots in order to make the shape of the sample point visible. Even in a shades-of-grey depiction (in as the patent text), the positions of the various atoms are readily discernible by the different shades of grey. The three-dimensional reconstruction is also described qualitatively in the following and also supplemented quantitatively by the one-dimensional concentration profile of FIG. 6. In particular, it can be seen in FIG. 5 that the C and B atoms are distributed uniformly in the Mo base material in the upper part of the sample point, which corresponds to the region of the grain interior. In the lower part of the sample point, an area in which the B and C atoms are greatly concentrated runs perpendicular to the longitudinal extension of the sample point. As explained above in respect of atom probe tomography, this makes the profile of a grain boundary section 2 located in the sample point visible, since the B and C atoms are greatly concentrated in this.

As described above in respect of atom probe tomography and shown in graph form in FIG. 5 by the three-dimensional cylinder 4, a measurement cylinder 4 is drawn by the measurement software in the three-dimensional reconstruction in such a way that its cylinder axis 6 runs perpendicular to the plane spanned by the grain boundary section 2 in order to determine the segregation of B and C quantitatively in the region of the grain boundary section relative to the region of the grain interior. In the present case, a measurement cylinder 4 having a length of 20 nm (along the cylinder axis) and a diameter of 10 nm was selected. In the depiction in FIG. 5, the grain boundary section 2 is located centrally (based on the cylinder axis 6) within the measurement cylinder 4.

Figure 6:
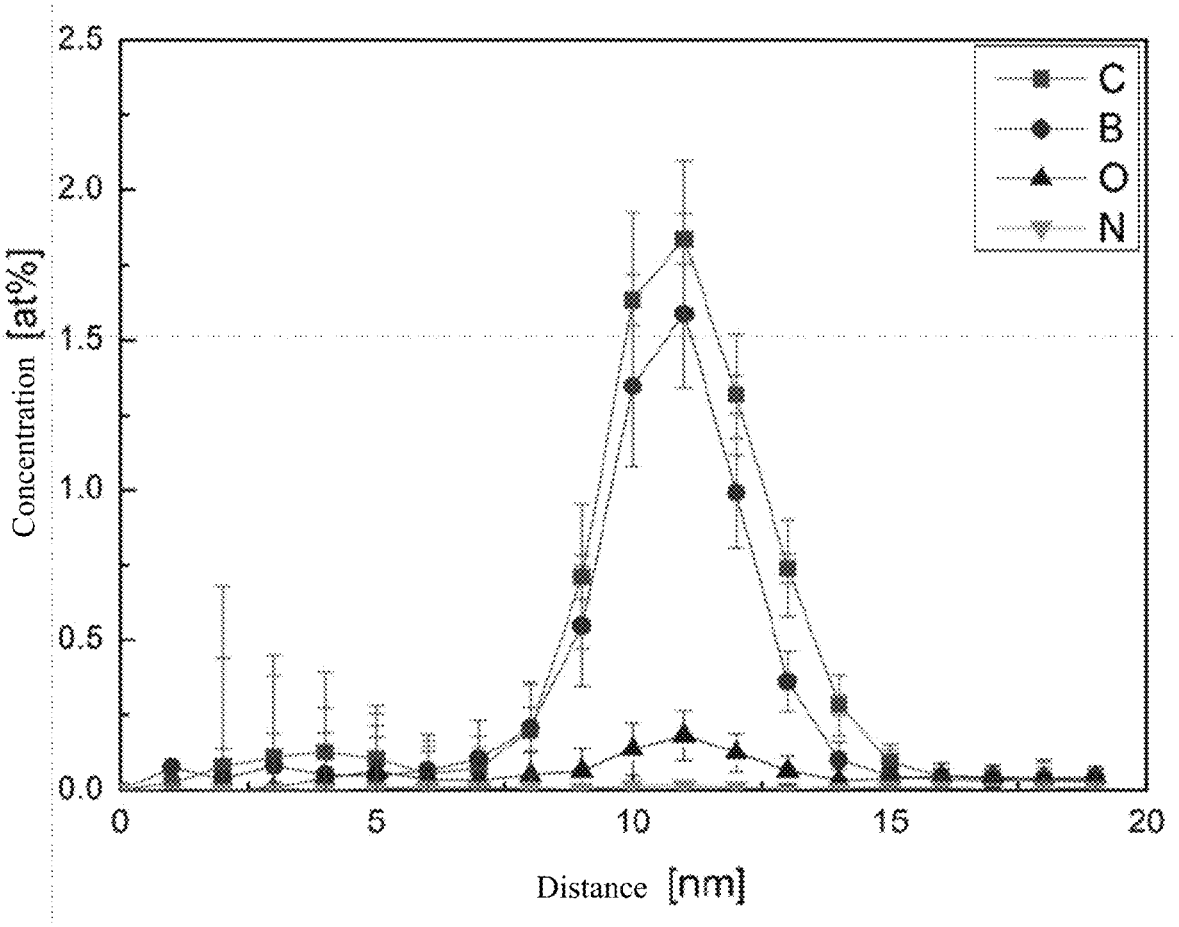
FIG. 6: graph of the linear or one-dimensional concentration profile of the elements C, B, O and N corresponding to the three-dimensional reconstruction shown in FIG. 5 along the cylinder axis drawn in in FIG. 5.

The linear concentration profile of the elements C, B, O and N along the cylinder axis 6 of the measurement cylinder 4 was subsequently determined in the manner explained above in respect of atomic probe tomography. FIG. 6 shows the resulting linear concentration profile in graph form. The grain boundary section can be seen from the great increase in the concentration of the elements B and C (cf. in particular, the values in the range 9 nm-3 nm along the axis "Distance"). As can be seen from FIG. 6, the oxygen content is increased only slightly in the region of the grain boundary and the N content is substantially constant at a low level, which is advantageous with regard to the grain boundary strength.

In the following, the further procedure in order to express the proportion of B and C in the region of the grain boundary section 2 as a ratio to the proportion thereof in the region of the grain interior will be described more specifically with the aid of FIG. 6. As has been described above in detail in respect of this evaluation, five adjoining discs (each having a thickness of 1 nm) of the measurement cylinder 4, in which the sum of the measured concentrations B and C is a maximum, are selected as the three-dimensional cylindrical region representative of the grain boundary section. These are in the present case the measured values at the "distances" 9, 10, 11, 12 and 13 nm. As the cylindrical region of the grain interior to be examined, the five adjoining discs whose central disc is at a distance of 10 nm from the central disc of the cylindrical region of the grain boundary section are selected. These would be, in the depiction of FIG. 6, the measured values at the distances 3, 2, 1, 0, −1 (the latter value in the present case not encompassed by the measurement cylinder). The proportions of B, C and of B and C in total were subsequently determined for these two regions (of the grain boundary section and also of the grain interior) and expressed as a ratio to one another, as is described in detail above. As can be seen from the depiction in graph form in FIG. 6, the proportion of carbon and boron is in each case individually and also in total at least three times as high in the region of the grain boundary section as in the region of the grain interior of the adjoining grain. Furthermore, it can be seen from FIG. 6 (and also from FIG. 5) that B and C are (particularly in the grain interior) finely and uniformly distributed and also greatly concentrated in the region of the large angle grain boundaries.

Production Example

Molybdenum powder produced by reduction by means of hydrogen was used for the powder-metallurgical production of a sintered molybdenum part according to the invention. The grain size determined by the Fisher method (FSSS in accordance with ASTM B330) was 4.7 μm. The molybdenum powder contained 10 ppmw of carbon, 470 ppmw of oxygen, 135 ppmw of tungsten and 7 ppmw of iron as impurities. Including the amount of B and C present after reduction in the molybdenum powder (in the present case: C content of 10 ppmw; B not detectable), such amounts of C- and B-containing powder (39 ppmw of C and 31 ppmw of B) were added that a total proportion of 49 ppmw of carbon and 31 ppmw of boron was set in the molybdenum powder. The powder mixture was homogenized by mixing for 10 minutes in a ploughshare mixer. Subsequently, this powder mixture was introduced into appropriate tubes and cold isostatically pressed at a pressing pressure of 200 MPa at room temperature for a time of 5 minutes. The pressed bodies produced in this way (round rods each weighing 480 kg) were sintered in indirectly heated sintering plants (i.e. heat transfer to the material being sintered by thermal radiation and convection) at a temperature of 2050° C. for a time of 4 hours in a hydrogen atmosphere and subsequently cooled. The sintered rods obtained in this way had a boron content of 22 ppmw, a carbon content of 12 ppmw and an oxygen content of 7 ppmw. The tungsten content and the proportion of other metallic impurities remained unchanged.

The sintered molybdenum rods according to the invention were deformed on a radial forging machine at a temperature of 1200° C., with a diameter reduction from 240 to 165 mm being carried out. Ultrasonic examination of the rod having a density of 100% did not display any cracks even in the interior and metallographic polished sections confirmed this finding.

Welding Test:

Sintered molybdenum parts according to the invention in sheet form were welded to one another by means of a laser welding process. The following welding parameters were set:

Laser type: Trumpf TruDisk 4001
Wavelength: 1030 nm
Laser power: 2.750 W (watt)
Focus diameter: 100 μm (micron)

Welding speed: 3600 mm/min (millimetres per minute)

Focus position: 0 mm

Protective gas: 100% argon

Studies on the microstructure showed that a uniform, relatively fine-grain microstructure had been formed even in the region of the welding zone. The welded sintered molybdenum parts had a comparatively high ductility even in the region of the weld connection, which was confirmed in a bending test in which bending angles of >70° were attained.

EBSD Analysis to Determine the Drain Boundaries:

The EBSD analysis which can be carried out using a scanning electron microscope is explained below. For this purpose, a cross section through the sintered molybdenum part to be examined was produced in the sample preparation. The preparation of a corresponding polished section is carried out, in particular, by embedding, grinding, polishing and etching of the cross section obtained, with the surface subsequently also being ion-polished (to remove the deformation structure on the surface arising from the grinding operation). The measurement arrangement is such that the electron beam impinges at an angle of 20° on the prepared polished section. In the scanning electron microscope (in the present case: Carl Zeiss "Ultra 55 plus"), the distance between the electron source (in the present case: field emission cathode) and the specimen is 16.2 mm and the distance between the specimen and the EBSD camera (in the present case: "DigiView IV") is 16 mm. The information given in parenthesis relate in each case to the instrument types used by the applicant, but it is in principle also possible to use other instrument types which permit the functions described in a corresponding way. The acceleration voltage is 20 kV, a magnification of 500× is set and the spacing of the individual pixels on the specimen, which are scanned in succession, is 0.5 μm.

In the EBSD analysis, large angle grain boundaries (e.g. running around a grain) and large angle grain boundary sections (e.g. having an open beginning and end) which have a grain boundary angle which is greater than or equal to the minimum rotation angle of 15° can be made visible within the area examined on the specimen. Large angle grain boundaries or large angle grain boundary sections within the specimen area examined are always determined and shown between two scanned points by the scanning electron microscope when an orientation difference between the crystal lattice of ≥15° is found between the two scanned points. For the present purposes, the orientation difference is in each case the smallest angle which is required to make the respective crystal lattices present at the scanned points to be compared coincide. This procedure is carried out at each scanned point in respect of all scanned points surrounding it. In this way, a grain boundary pattern of large angle grain boundaries and/or large angle grain boundary sections is obtained within the specimen area examined.

The invention claimed is:

1. A powder-metallurgical sintered molybdenum part being present as a solid body, the sintered molybdenum part comprising the following composition:

a. a molybdenum content of ≥99.93% by weight;

b. a boron content "B" in a range of 5≤"B"≤45 ppmw and a carbon content "C" in a range of 5≤"C"≤30 ppmw, with a total content "BaC" of carbon and boron being in a range of 15 ppmw≤"BaC"≤50 ppmw;

c. an oxygen content "O" in a range of 3 ppmw≤"O"≤20 ppmw, d. a maximum tungsten content of ≤330 ppmw;

e. a maximum proportion of other impurities of ≤300 ppmw; and f. a maximum proportion of additives of Zr, Hf, Ti, V and Al of ≤50 ppmw.

2. The sintered molybdenum part according to claim 1, wherein said oxygen content "O" is in a range of 5≤"O"≤15 ppmw.

3. The sintered molybdenum part according to claim 1, which further comprises:

a maximum proportion of contamination by silicon, rhenium and potassium of ≤20 ppmw in total.

4. The sintered molybdenum part according to claim 1, which further comprises a total content of molybdenum and tungsten of ≥99.97% by weight.

5. The sintered molybdenum part according to claim 1, wherein said carbon and said boron are present in dissolved form in a total amount of at least 70% by weight based on said total content of carbon and boron.

6. The sintered molybdenum part according to claim 1, wherein said boron and said carbon are finely dispersed and are present in an increased concentration in a region of large angle grain boundaries.

7. The sintered molybdenum part according to claim 1, wherein the sintered molybdenum part has sections and has a preferential orientation of at least one of large angle grain boundaries or large angle grain boundary sections perpendicular to a main forming direction.

8. The sintered molybdenum part according to claim 1, wherein the sintered molybdenum part has a partially or fully recrystallized structure, at least in sections.

9. The sintered molybdenum part according to claim 1, which further comprises a weld connection for joining the sintered molybdenum part to a further sintered molybdenum part having a composition identical the sintered molybdenum part, said weld connection including a weld zone having a molybdenum content of ≥99.93% by weight.

10. The sintered molybdenum part according to claim 1, wherein the following applies at least at a grain boundary section of a large angle grain boundary and an adjoining grain:

a total proportion of carbon and boron in a region of said grain boundary section is at least one and one half times a total proportion of carbon and boron in a region of a grain interior of said adjoining grain, measured in atom percent by three-dimensional atom probe tomography;

a three-dimensional, cylindrical region having a cylinder axis running perpendicular to said grain boundary section and a thickness running along said cylinder axis of 5 nm which, relative to a cylinder axis direction, laid centrally around said grain boundary section is selected for said region of said grain boundary section; and a three-dimensional, cylindrical region having identical dimensions and an identical orientation and having a center 10 nm away from said grain boundary section in said cylinder axis direction is employed for said region of said grain interior.

11. The sintered molybdenum part according to claim 10, wherein said total proportion of said carbon and said boron in said region of said grain boundary section is at least three times said total proportion of said carbon and said boron in said region of said grain interior of said adjoining grain.

12. A process for producing a sintered molybdenum part, the process comprising the following steps:

producing the sintered molybdenum part having a molybdenum content of ≥99.93% by weight, a boron content "B" in a range of 5≤"B"≤45 ppmw and a carbon content "C" in a range of 5≤"C"≤30 ppmw, a total content "BaC" of carbon and boron in a range of 15 ppmw≤"BaC"≤50 ppmw, an oxygen content "O" in a range 3 ppmw≤"O"≤20 ppmw, a maximum tungsten content of ≤330 ppmw, a maximum proportion of other impurities of ≤300 ppmw and a maximum proportion of additives of Zr, Hf, Ti, V and Al of ≤50 ppmw, by:

a. pressing a powder mixture composed of molybdenum powder and boron-containing and carbon-containing powders to give a green body; and b. sintering the green body in an atmosphere protecting against oxidation for a residence time of at least 45 minutes at temperatures in a range of 1600° C.-2200° C.

* * * * *